US007346421B2

(12) United States Patent
Bijvoet

(10) Patent No.: US 7,346,421 B2
(45) Date of Patent: Mar. 18, 2008

(54) PRODUCTION OF MADE TO ORDER CLOTHING

(75) Inventor: Michel Bijvoet, Zolder (BE)

(73) Assignee: Douelou NV, Hassett (BE)

( * ) Notice: Subject to any disclaimer, the term of this patent is extended or adjusted under 35 U.S.C. 154(b) by 501 days.

(21) Appl. No.: 10/415,036

(22) PCT Filed: Oct. 30, 2001

(86) PCT No.: PCT/BE01/00190

§ 371 (c)(1),
(2), (4) Date: Oct. 24, 2003

(87) PCT Pub. No.: WO02/35952

PCT Pub. Date: May 10, 2002

(65) Prior Publication Data

US 2004/0078285 A1 Apr. 22, 2004

(30) Foreign Application Priority Data

Oct. 30, 2000 (BE) ..... 2000/0691

(51) Int. Cl.
*G06F 19/00* (2006.01)

(52) U.S. Cl. ..... 700/132; 700/130; 705/26

(58) Field of Classification Search ..... 700/130, 700/131, 132, 133, 134, 135, 136, 137, 155; 702/155, 166, 167; 705/1, 26; 707/4
See application file for complete search history.

(56) References Cited

U.S. PATENT DOCUMENTS 4,149,246 A * 4/1979 Goldman ..... 700/132
4,598,376 A * 7/1986 Burton et al. ..... 700/132
5,163,007 A * 11/1992 Slilaty ..... 700/132
5,680,528 A * 10/1997 Korszun ..... 345/630
5,850,222 A * 12/1998 Cone ..... 345/418
5,930,769 A * 7/1999 Rose ..... 705/27
6,307,568 B1 * 10/2001 Rom ..... 345/629
6,310,627 B1 * 10/2001 Sakaguchi ..... 345/630
6,353,770 B1 * 3/2002 Ramsey et al. ..... 700/131
6,415,199 B1 * 7/2002 Liebermann ..... 700/132
6,516,240 B2 * 2/2003 Ramsey et al. ..... 700/131
6,546,309 B1 * 4/2003 Gazzuolo ..... 700/132
6,564,118 B1 * 5/2003 Swab ..... 700/131
6,665,577 B2 * 12/2003 Onyshkevych et al. ..... 700/130

(Continued)

FOREIGN PATENT DOCUMENTS

DE 19635753 A1 4/1998

(Continued)

*Primary Examiner*—Gary L. Welch
*Assistant Examiner*—Nathan E Durham
(74) *Attorney, Agent, or Firm*—Barnes & Thornburg

(57) ABSTRACT

An arrangement for the production of made to order clothing (18), comprising a controller (14) operatively connected (12) to an input means (10), said input means (10) being adapted to provide to said controller (14) input variables A, W, H, C personal to a particular customer and said controller (14) being adapted to process said input variables A, W, H, C to predict a set of at least estimated body measurements, each of which body measurements is derived from one or more of said input variables A, W, H, C and is used to derive clothing pattern data, one said input variable being representative of the age A of said customer.

23 Claims, 5 Drawing Sheets

U.S. PATENT DOCUMENTS

| | | | | |
|---|---|---|---|---|
| 6,701,207 | B1 * | 3/2004 | Gazzuolo | 700/132 |
| 6,901,379 | B1 * | 5/2005 | Balter et al. | 705/27 |
| 6,968,075 | B1 * | 11/2005 | Chang | 382/111 |
| 2001/0026272 | A1 * | 10/2001 | Feld et al. | 345/419 |
| 2006/0059054 | A1 * | 3/2006 | Adiseshan | 705/26 |

FOREIGN PATENT DOCUMENTS

| | | | |
|---|---|---|---|
| DE | 19956574 | A1 | 5/2001 |
| EP | 0537388 | A1 | 4/1993 |
| JP | 2000248413 | | 9/2000 |
| JP | 2000248413 | A * | 9/2000 |
| WO | WO 98/15904 | A1 | 4/1998 |
| WO | WO 00/70976 | A1 | 11/2000 |
| WO | WO 01/30189 | A2 | 5/2001 |

* cited by examiner

PRODUCTION OF MADE TO ORDER CLOTHING

FIELD OF THE INVENTION

The present invention relates to the production of made to order clothing and in particular to an arrangement in which a customer can be remote from the point of production and indeed often does not need to be measured in advance by a tailor.

BACKGROUND TO THE INVENTION

In the production of made to order clothing, one of the key tasks is to provide the information used to cut each piece of material into the right size. The gathering of this information has traditionally been the task of a tailor and its reliability is dependent on years of training and experience held by these highly skilled artisans.

Using a tailor, however, does not always suit potential customers. It is, first of all, necessary to get to one in the first place and this may not be possible or convenient. Perhaps a particularly relevant consideration presently is the rapid expansion of remote purchasing, in which use of for example the internet has led many customers away from the traditional approach to specialised services or even high street shopping. Customer expectations are changing in many segments and the field of clothing is no exception.

In U.S. Pat. No. 5,163,007 is disclosed an arrangement in which a computer is used to generate cutting data from information supplied by a customer and measurements taken by a third party. This third party need not be a skilled tailor and can for example be a shop assistant. The computer uses the information supplied to generate the cut data while at the same time compensating for errors which might otherwise creep in from inconsistencies between sets of measurements supplied by different measuring parties or inaccuracies in the measurements supplied by the customer. This scheme reduces the skill level required of the person gathering the measurements and therefore increases the number and convenience of places where the customer can be measured. It will be noted, however, that it is still necessary to have some interaction with a third party and this scheme is therefore not ideal for implementation using for example home internet access.

Schemes have been proposed which measure the customer using a technical aid, such as those in EP 0554647, EP 0933728 and WO 95/04975. In schemes such as these, it is necessary to provide complex and expensive apparatus at the point of ordering and then to induce customers to visit and be measured, photographed or scanned as the case may be.

In U.S. Pat. No. 5,680,528 is disclosed a digital dressing room used to produce clothes from customer measurements. Those measurements are used to classify the individual by body type and reference is made to a database to obtain cut data based on the individual's particular shape. The customer inputs to this system are bust, waist, hips and height. These measurements are all done with a tape measure and need quite a degree of skill to get right. A similar scheme is disclosed in U.S. Pat. No. 5,930,769 which, in common with U.S. Pat. No. 5,680,528, still relies on accurate measurement information and their successful implementation may be compromised by a lack of skill of many potential customers to self-measure.

Generally, conventional remote order systems have a high return rate of clothes from dissatisfied customers—typically of the order 30%.

It is an object of the present invention to provide an improved arrangement and method for the production of made to order clothing.

It is a further object of the present invention to improve the suitability of clothing designs based on personal data input to a made to order clothing system.

SUMMARY OF THE INVENTION

Accordingly, the present invention provides an arrangement for the production of made to order clothing, comprising a controller operatively connected to an input means, said input means being adapted to provide to said controller input variables personal to a particular customer and said controller being adapted to process said input variables to predict a set of at least estimated body measurements each of which body measurements is derived from one or more of said input variables and is used to derive clothing pattern data, one said input variable comprising a representation of the age of said customer. The age may be a number of years but it can be any suitable representation such as the date of birth. This data need not be input by the customer but could be input from other means, e.g. the age can be obtained from a supplied date of birth or electronically stored medical records. The age is preferably represented as a number of years.

Said input variables may further include an input of one or more of the weight, height, collar size, sleeve length and waist of said customer.

Said predicted body measurements may include at least one of chest circumference, waist circumference, arm circumference, wrist circumference, shoulder length, arm length and back length.

Said body measurements may be predicted by reference of a plurality of said input variables to a set of predictor rules which are applied in association with said controller.

Said predictor rules may link said input variables to customer body measurements which are unknown to said controller and generate said estimated body measurements for use in the place of said unknown body measurements.

Said predictor rules may include the application of a regression technique, preferably a multiple linear regression technique.

Said predictor rules may be derived from a database of body measurements of a population sample, said sample preferably being composed of at least twenty times more cases than there are variables to be entered and body dimensions to be predicted.

Said predictor rules may be changeable between at least two applications thereof, so as for example to reflect changes in said sample over time, between target markets or between geographical areas. A said set of predictor rules may be generated each time an order is placed or each time a reference database of sample body measurements is changed.

Said made to order clothing may include a shirt or may include a blouse or jacket.

Said made to order clothing may include a pair of trousers and said input variables may preferably include one or more of foot size, shoe size, inside leg and seam size. In at least this case, said made to order clothing may further include a jacket, and optionally a waistcoat, in combination with said trousers so as for example to form a suit.

Said customer may input a command with regard to the structure of at least a portion of said clothing, such as for example a type of material, colour, shape or fit, collar, cuff or sleeve design, said command preferably being changeable by said customer on review of a predicted or simulated finished piece of said clothing.

Said input means may include an input stage performed using at least one of a wide area network (WAN), a local area network (LAN), a mobile telecommunications network, an internet ordering process and an interactive mail order process, performed for example interactively by said customer in response to supplier prompts.

The arrangement may further comprise a clothing manufacturing facility, adapted to receive from said controller said pattern data and to produce said made to order clothing therefrom.

The arrangement may further comprise a billing and distribution arrangement for billing customers and shipping to them said made to order clothing.

Said customer may be provided with a representation of said made to order clothing, said virtual representation preferably being displayed in three dimensions and being moveable so as to show what said clothing might look like from different angles or points of view. Said customer may also be provided with a representation of a virtual person, preferably representative of their body shape in accordance with said estimated body measurements, wearing a piece of said made to order clothing in accordance with said pattern data, said virtual person preferably being presented in three dimensions and preferably being moveable so as to demonstrate by way of review what said clothing might look like in use. Said representation may be available to said customer in a plurality of different poses and backgrounds, such as for example simulations of posing or moving in urban and countryside environments, preferably with the possibility of additional virtual figures being present therein. Said representation may be available to said customer wearing clothing in addition to said made to order clothing, such as for example, in a case where said made to order clothing comprises a shirt, said additional clothing comprising a choice of trousers, whereby said customer can assess said made to order clothing in a variety of combinations and styles in overall dress.

The present invention also provides an arrangement for the production of made to order clothing, comprising a controller operatively connected to an input means, said input means being adapted to provide to said controller input variables personal to a particular customer and said controller being adapted to process said input variables to predict a set of at least estimated body measurements, each of which body measurements is derived from one or more of said input variables and is used to derive clothing pattern data, said input variables comprising only the age, weight, height and collar size of said customer.

The present invention also provides an information carrier, such as a CD-ROM, on which is encoded at least one program to enable implementation of an arrangement according to the invention, a said program comprising for example at least one of a web-site interface, a database of clothing options or dimension information, a web browser, an ordering/billing system and an imaging program for enabling the display of an image of said made to order clothing.

The present invention also provides a method of producing made to order clothing, including:

a) inputting into a controller input variables personal to a particular customer, one said input variable comprising a representation of the age of said customer,
b) processing said input variables; and
c) predicting a set of at least estimated body measurements from said processing, each of which body measurements is derived from one or more of said input variables and is used in the derivation of clothing pattern data The invention may also provide an arrangement in which a record is made, in for example a database, of feedback from orders placed using the invention. This feedback may take the form of warranty return information or customer feedback and may comprise one or both of positive and negative results. Said record may also be used to record cases in which it proves difficult or impossible to satisfy a customer, by which the information so gathered could also be used to protect a supplier of made to measure clothing produced using the invention against customers who are difficult to satisfy, for example by making a record of customers who habitually return goods for whatever reason.

BRIEF DESCRIPTION OF THE DRAWINGS

The present invention will now be described by way of example only and with reference to the accompanying drawings, in which.

DETAILED DESCRIPTION

Figure 1:
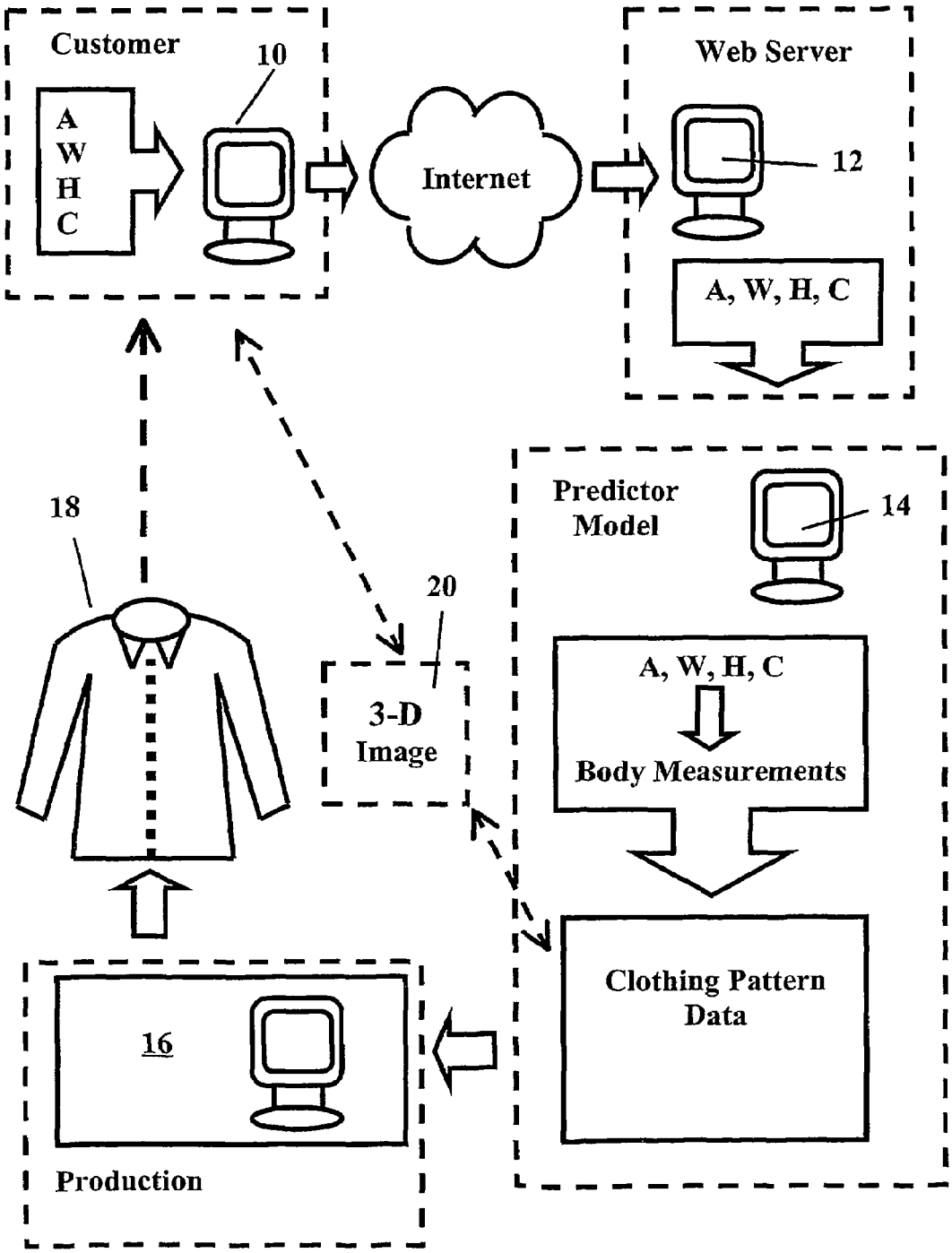
FIG. 1 is a schematic diagram of an arrangement according to an embodiment of the present invention.

Referring to the drawings, an arrangement for the production and distribution of made to measure clothing comprises an input stage performed using an interactive interface 10 which implements an internet or mail order based scheme by communicating through the internet with a web server 12 at a made to measure order, billing, production and distribution premises.

A user of the interface 10 responds to prompts for information and inputs variables comprising information personal to a particular customer ordering a piece of made to measure clothing. In this embodiment the item of clothing assumed to be ordered is a shirt 18, for which the input variables supplied are the age A, weight W, height H and collar size C of the customer, collar size also being referred to interchangeably in the art as neck girth N.

At this stage, the customer also inputs a command with regard to their choice of structure of at least a portion of the clothing being ordered, such as for example a type of material, colour, shape or fit, collar, cuff or sleeve design.

The web server 12 captures the customer-specific input variables and choices and relays that information to a controller 14, which stores the customer choices and processes the input variables A, W, H, C in accordance with a set of rules in a predictor model.

By applying these rules, the controller 14 predicts a set of body measurements which are an estimate of the unknown body measurements. The predicted body measurements comprise chest circumference, waist circumference, arm circumference, wrist circumference, shoulder length, arm length and back length and optionally also the belly circumference.

The controller 14 then turns the complete set of body measurements into a set of clothing pattern data. At this stage, the customer is provided with a representation 20 of a virtual piece of clothing, displayed in accordance with the model they have chosen. The virtual clothing is preferably interactively updateable in its characteristics to simultaneously reflect changes that could take place in the customer's choices in structure and options. It is preferably presented in three dimensions and moveable so as to be seen from different points of views.

The virtual representation 20 may be extended to the rendering of a virtual person, preferably representative of the customer's predicted body shape in accordance with the estimated body measurements, wearing the made to order clothing selected in accordance with the pattern data generated by the controller 14. The virtual person is preferably presented in three dimensions (3-D) and is preferably moveable so as to demonstrate by way of review what the clothing might look like in use. Such virtual representations are known in the art and a suitable example of this technology can be found in EP0933728.

The virtual representation 20 may be available to the customer in a plurality of different poses and backgrounds, such as for example simulations of posing or moving in urban and countryside environments, preferably with the possibility of additional virtual figures being present. It may also be available to the customer wearing clothing in addition to the made to order shirt 18, such as for example a choice of trousers. In this way, the customer can assess the shirt in a variety of settings, combinations and styles in overall dress. At this stage, the customer can alter their choices of style or even fit, by for example requesting a looser fitting. Once such choices and changes have been dealt with in the simulation, the customer is prompted to confirm or reject the order.

If the order is confirmed, the customer is put through an on-line billing scheme to set the order into production. It will be appreciated, of course, that customer accounts, charge cards and other similar schemes may be used for billing. Once the billing has been processed, the clothing pattern data is passed to a clothing manufacturing facility. This is includes a computer aided manufacturing plant 16 which selects the material from the choices stored in the controller 14 from the customer inputs/changes and cuts the material to the pattern data for the ordering customer. The output of the plant 16 is a shirt 18 made to order for the specific customer placing the order and it is then passed to a distribution centre (not shown separately) and subsequently shipped to the customer.

In a slightly different embodiment, the customer is prompted for the personal information required for designing the pattern not at the beginning of the order process but later on, after having chosen the clothing and just before billing. Unknown body measurements are estimated in the same way and pattern data is similarly derived from that prediction.

More detailed consideration will now be given to the development and application of the predictor rules and the significance of the particular input variables requested.

The fundamental consideration upon which the calculation of the rules is based is that, in a given population, there exists some correlation between certain body measurements. For example, there is a proven correlation between body height and arm length. Another fundamental consideration is that there exists some correlation between the age and certain body measurements like the height or the waist girth. The identification of correlation between known variables (e.g. the input variables A, W, H, C) and unknown body measurements allows the construction of a predictive model and its use for the purpose of their estimation.

Figure 2:
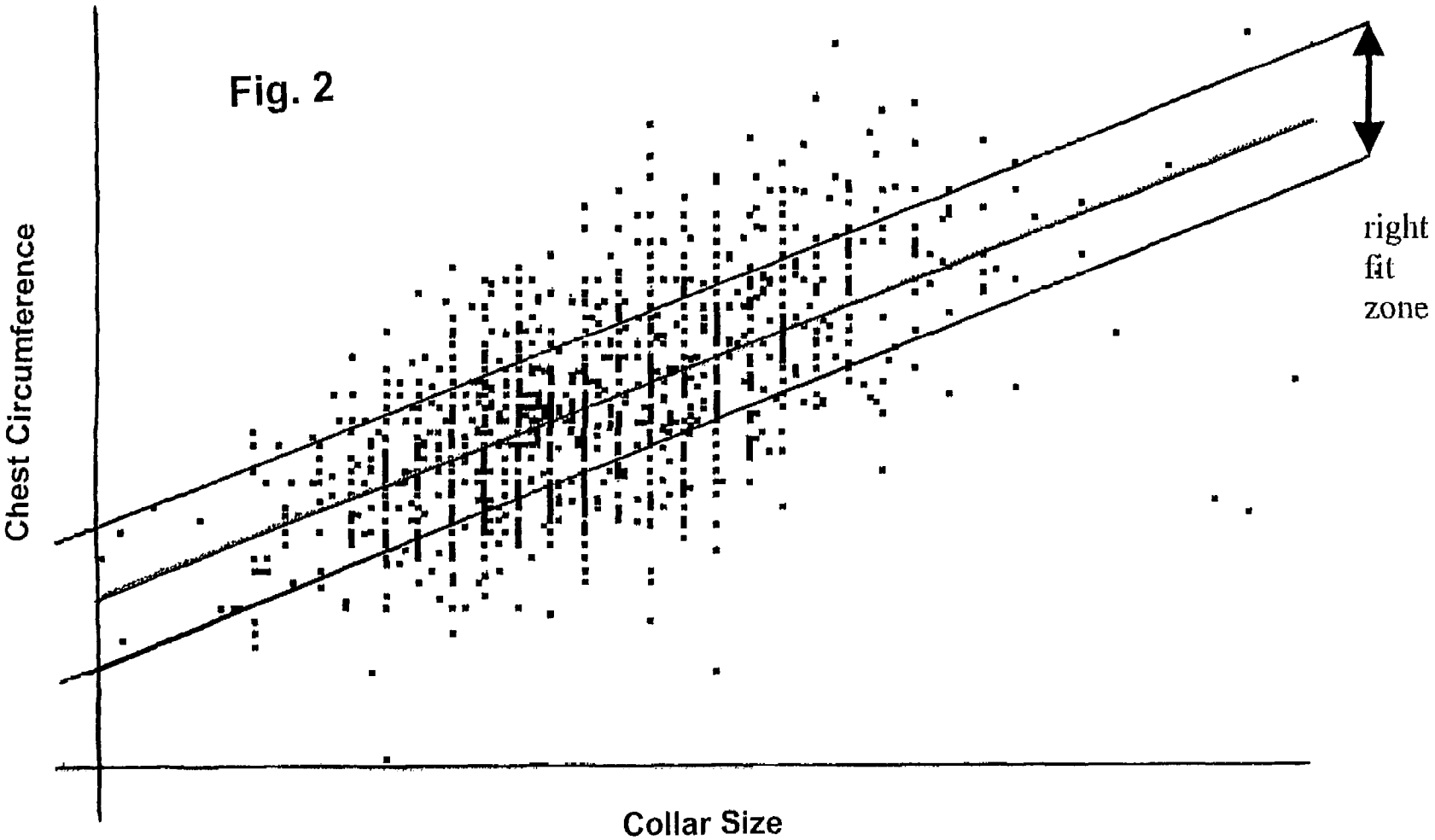
FIGS. 2 to 5 are graphical representations of information used in the development of the arrangement of FIG. 1.

Referring in particular to FIG. 2, an estimation of the chest circumference using only one particular input variable can be seen to be quite inaccurate. In this case, the input variable is the collar size C and the body measurements represent a sample of potential customers. Chest girth is plotted against collar size C/neck girth and a "right fit zone" is developed around a best-fit line through the population. The chart represents the principle of a basic ready-to-wear industry sizing system. In this system, chest girth is assumed to be proportional to neck girth, which can be seen to be true to a certain extent but can leave many potential customers with fitting problems and is not accurate enough for made to measure clothing.

Figure 3:
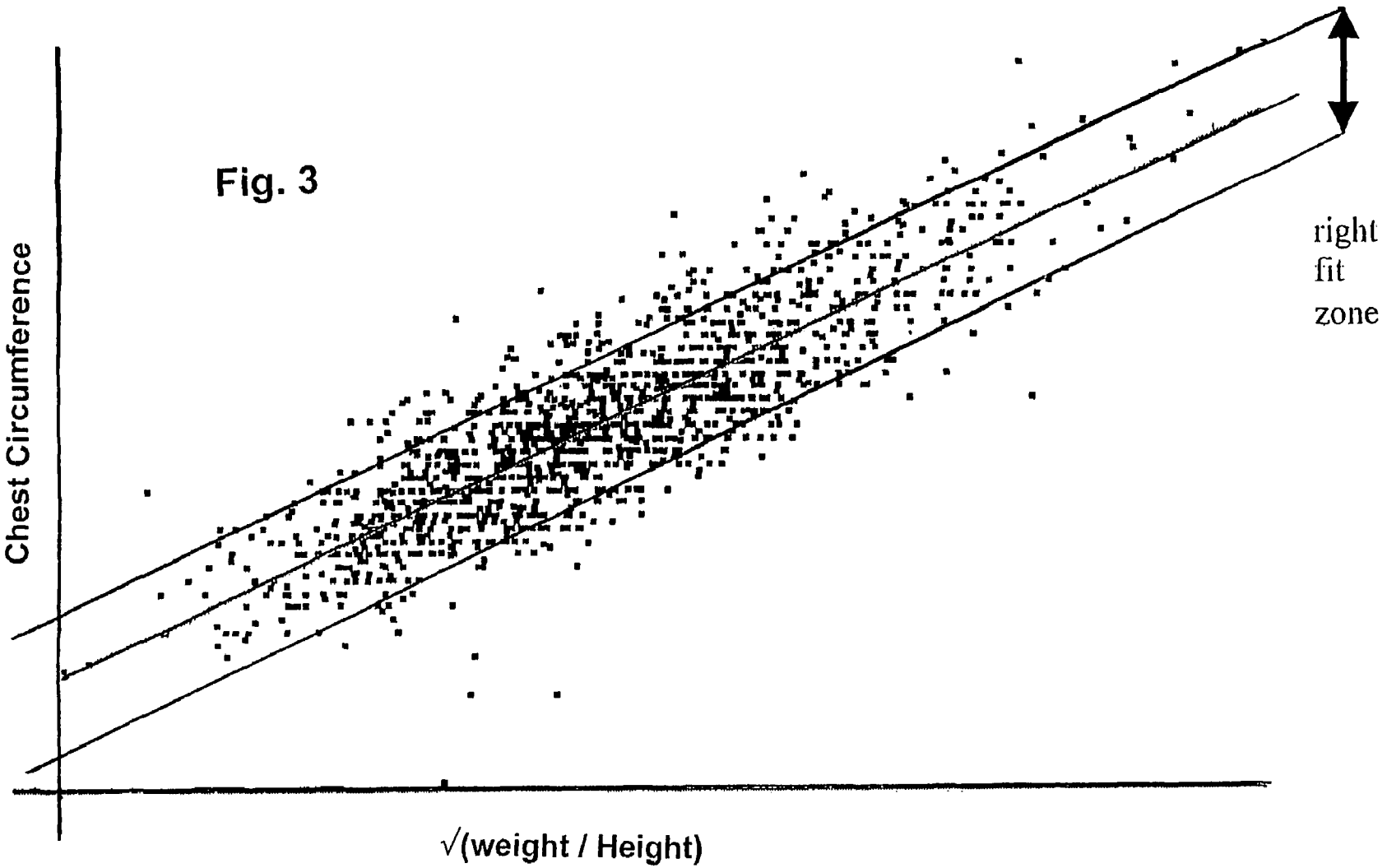

In FIG. 3, an estimation of the chest circumference is demonstrated knowing two personal measurements, weight and height plotted on the x-axis in the form of the square root of (weight/height). In this chart, we introduce two body measurements instead of one to estimate the chest girth. It can be seen that the correlation between available data and the estimation is clearer. Less potential customers are left with fitting problems.

Figure 4:
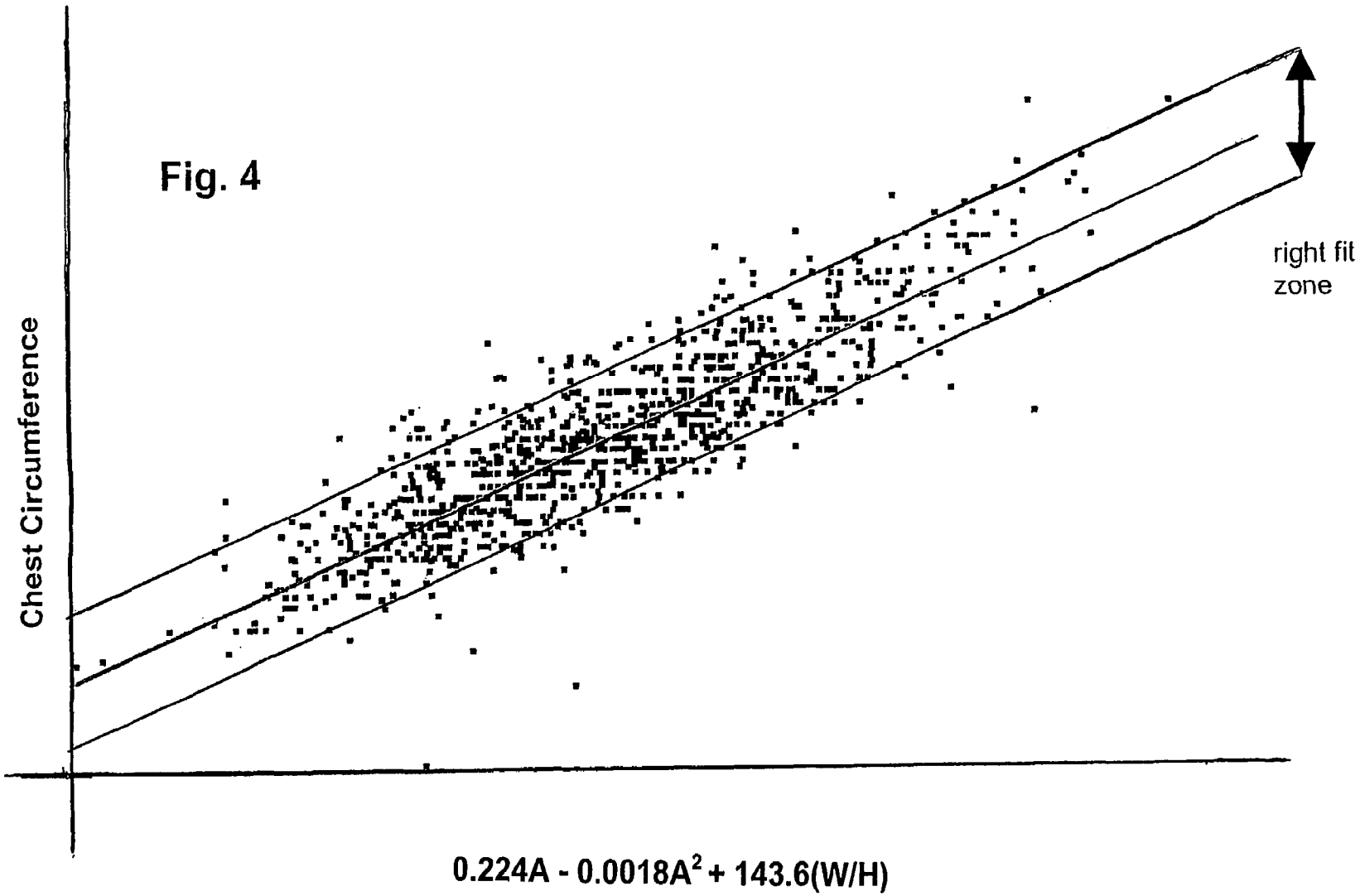

From FIGS. 2 and 3, it can be seen that increasing the number of input variables increases the accuracy of estimated body measurements and those chosen in the present invention are believed to produce a good compromise between accuracy and easy of use for customers. The input variables requested are often known by heart or at least easily determined without specialist help. In FIG. 4, the effects of including age A in a predictor rule can be seen to improve the results of the prediction of FIG. 3.

After selecting the input variables A, W, H, C, the next step in developing the present invention is to build up the predictive model and its associated rules. The predictive model is based on regression techniques. Such regression techniques are aimed at establishing mathematical relationships between variables for predictive purposes, providing a significant sample of cases is gathered. The relationships are formalised as functions that describe how one dependent variable reacts when an independent variable is changed. The functions that are chosen are those that on average best describe the relationship between variables.

Of course, the functions only approximate the average behaviour of the population and, although the prediction is generally satisfactory in most cases, an error can often be noticed when comparing the prediction with the actual value. The selected functions are the ones that minimise the absolute error between actual sample values and values calculated using the regression function. The techniques must be "multiple regression" because it is necessary to deal with several variables, e.g. four independent variables (age A, weight W, height H, and collar size C) and several variables dependent on them, i.e. the predicted body measurements of chest circumference, waist circumference, arm circumference, wrist circumference, shoulder length, arm length; back length plus optionally belly girth.

Many multiple regression techniques would give close results in the present application. However, a linear multiple regression generally gives robust models and should preferably be chosen if the relationships between variables is roughly speaking linear. In order to tell if the relationship is linear or not, it is convenient to use standard statistical software packages that are available on the market, like SAS, SPSS, STATISTICA or others, that provide interactive graphical exploration of data facilities. In the case of the present invention, the software used was WINIDAMS. Using this software, the isolation of the relationships between couples of variables gives plots similar to those shown in FIG. 5.

Figure 5:
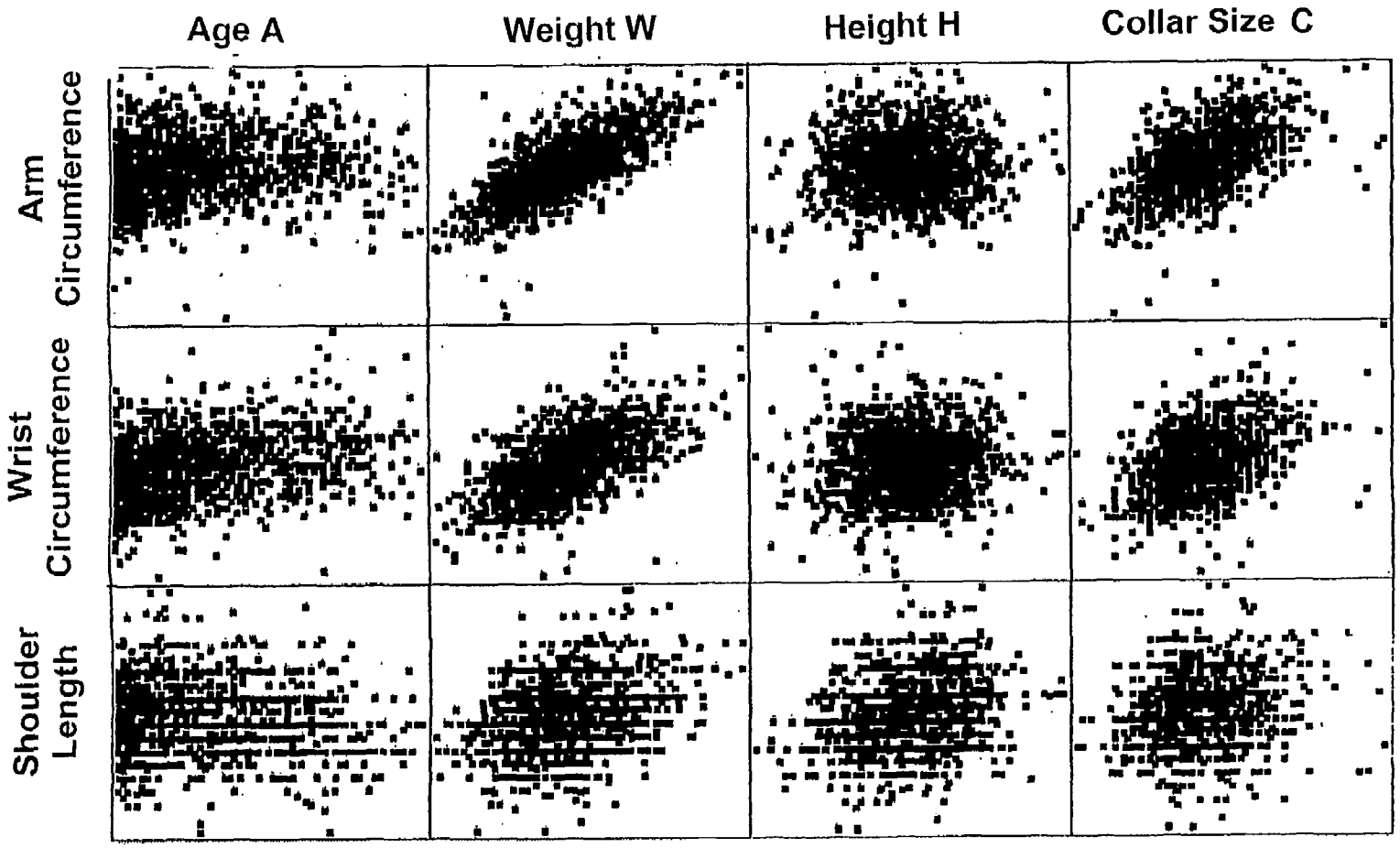

On these charts, the dependent variables are plotted against the independent variables. It is apparent that, although these charts are very useful, they only provide a partial view of the population's behaviour because they are only two-dimensional. In fact, we are interested by the multidimensional relationships between independent and dependent variables. In FIG. 5, it can be seen in some cases that there seem to be linear relationships (arm circumference against weight), non-linear relationships (arm circumference against age looking banana-shaped) and some rather undefined relationships (wrist girth against body height indicating a very loose correlation, if any).

In order to convert non-linear relationships to linear ones, it is necessary to introduce some variable changes. It can be seen that all relationships seemed to belong to the linear or undefined type, except when age A was involved. This is quite logical, as some body dimensions may grow with age up to a certain number of years and then decrease with the progression of age. For example, height and related body measurements such as leg length often fall into this category. To deal with a curve-shaped relationship, such as that between arm circumference and age, the predictor rules introduce for example the square of age as a dependent variable. This allows the approximation of the curve by a second-degree polynomial curve.

Some other relationships may also be found to be non-linear. Supposing that there is an analogy between body parts like the chest or the arm and a cylinder, it is possible to identify the relationship between body measurements of circumference and the given information of weight and height.

Indeed, for a cylinder, if v is the volume, c the circumference, r the radius, h the height, w the weight, we have:

$$v=\pi r^2 h=>r\pi^{1/2}=(v/h)^{1/2}$$

$$c=2\pi r=>c=2\pi^{1/2}(v/h)^{1/2}=>c \text{ proportional to } (v/h)^{1/2}$$

and if weight w is assumed to be proportional to v we have:

c proportional to $(w/h)^{1/2}$.

As a result $(w/h)^{1/2}$ is introduced into the model as an additional independent variable.

At the end of this step we are left with a set of independent variables: age, weight, height, collar size/neck girth, square age, square root of the weight divided by square root of the height. These variables are all likely to fit usefully into the multiple linear regression model.

The next step is then to formalise the relationships between variables by a set of equations. This step is the real "modelling" step where all parameters of the regression are settled and the predictor rules are finalised. Here again a dedicated statistical package is useful, such as WINIDAMS, which preferably features a stepwise regression application.

Stepwise regression building allows for the simultaneous identification of the relationships between variables (i.e. to obtain a set of equations/predictor rules) and for checking the significance of the improvement that each independent variable adds to the model. In other words if the standard error of the prediction does not decrease significantly by using a certain independent variable, this variable can be dismissed.

At the end of the stepwise regression process, an exemplary model generally along the lines the following can be obtained:

Assuming that:

a=age (years), w=weight (kg), h=height (cm), and c=collar size/neck circumference (cm).

The predictor rules in this case were calculated from a representative sample of around 1400 Belgian males over 18 and using the ISO8559 definitions for body dimensions and read as follows (all results in cm):

| | |
|---|---|
| chest girth = | $-4.87 + 0.229a - 0.0019a^2 + 0.361c + 130.4(w/h)^{1/2}$ |
| belly girth = | $-70.7 + 0.232a + 0.802c + 185\ (w/h)^{1/2}$ |
| waist girth = | $86.2 + 0.21a - 0.423h + 0.246c + 0.742w$ |
| arm girth = | $-1.5 - 0.00034a^2 - 0.043h + 0.089c + 57.6\ (w/h)^{1/2}$ |
| wrist girth = | $4.2 + 0.00019a^2 + 0.02h + 15.3\ (w/h)^{1/2}$ |
| shoulder length = | $12.4 - 0.00012a^2 + 0.013h - 0.065c + 0.045w$ |
| arm length = | $6.1 + 0.047a + 0.326h - 0.165c + 0.058w$ |
| back length = | $7.9 + 0.02a + 0.3h + 0.149c + 0.072w$ |

It should be noted that this model is derived from one particular sample of one particular population. Using another sample or even changing the threshold level of significance in the stepwise regression, or retaining only strict linear relationships, or also changing the linear adjustment method, can result in very different looking equations. But the predicted values of the dependent variables will remain close.

Once the predictor rules have been constructed they are tested, preferably on another sample of the population, to calculate the standard deviation of the resulting estimations compared with the actual body sizes. This standard deviation should be found to be close to the standard deviation of the regression model. Once the whole process has been completed, a robust predictive model for body measurements is obtained that can be used in the design of patterns for personalised made to order shirts 18 and other clothing. To use statistical terms, the uncertainty of the pattern conformity to body shape has been reduced when compared with the ready-to-wear industry.

If over time there were changes in the population morphological characteristics, for example if the average human body becomes taller or heavier, the predictive model would become less accurate. However, it is possible to alter the model so that it reflects the evolution of the population. The regression simply has to be performed again in the exact same way but using a new, updated sample of individual variables. If an updated sample is continuously available, the rules can evolve continuously as well. In this case each time an order is placed or each time the sample is changed the regression could be performed to generate new rules.

More generally, if the invention has to be applied to a population presenting significant morphological differences compared with the original sample, the model can be recalculated on the basis of a new sample extracted from the considered different population. Such morphological differences can for example reflect specificities in the geographical or ethnic origin of the newly targeted population. Yet another improving step in the same direction would consist in adding to the model new personal variables representing the geographical or ethnic origin of the customer. Introducing the new variables in the regression would result in a single model that could be applied to different morphological types.

The use of age A as an independent input variable and within the predictor rules is of particular note. Its use has been found experimentally to lead in some cases to the following reduction in error of the estimates. The figures can be read as being the improvement in terms of prediction accuracy resulting from the use of the age variable A.

Evolution of the standard error of the estimate when using age A, weight W, height H and collar size, neck girth C instead of only weight W, height H and collar size C, tested on a sufficient sample:

| | without age (cm) | with age (cm) | improvement (%) |
|---|---|---|---|
| Chest circumference: | 3.81 | 3.68 | 3.5 |
| Belly circumference: | 5.29 | 4.77 | 9.8 |
| Waist circumference: | 4.40 | 3.56 | 19.0 |
| Arm circumference: | 1.90 | 1.86 | 1.7 |
| Wrist circumference: | 0.84 | 0.82 | 3.0 |
| Shoulder length: | 1.18 | 1.17 | 0.5 |
| Arm length: | 2.10 | 2.02 | 3.8 |
| Back length: | 2.50 | 2.49 | 0.5 |

While the present invention has been particularly shown and described with respect to a preferred embodiment, it will be understood by those skilled in the art that changes in form and detail may be made without departing from the scope and spirit of the invention.

For example, it would be preferable to also obtain an input variable indicative of arm or sleeve length and also an input variable of waist, as these would further increase accuracy. Should the embodiment described above be varied to provide a blouse, it would prove useful to obtain additional input variables specific to the female form and generally known to the customer, such as for example the bust size.

The invention may also be varied to produce other items of made to measure clothing such as, for example, trousers, where the use of age is also useful in the prediction of changes over time in for example the girth of thighs. As body height is in fact already 'known' by the model it can already generally take into account the effect of body length and its shrinkage due to age. The prediction of the back length is generally unaffected by the introduction of age into the model, although in absolute terms the back length may well be quite affected by age as space between vertebras reduces. Under such circumstances, it would also be preferable to request input variables indicative of foot and leg length, e.g. shoe size and inside seam. By using the invention to produce a jacket and trousers, complete suits can also be envisaged, with or without accompanying waistcoats.

To facilitate the implementation of the invention, an information carrier such as a CD-ROM could be provided, for example given away as a promotional gift or sold and redeemable against later purchases. On it would be encoded at least one program to enable implementation of the invention, comprising for example at least one of a web-site interface, a database of clothing options or dimension information, a web browser, an ordering/billing system and an imaging program for enabling the display of an image as discussed above.

It will be appreciated that the results of the samples taken while building the database could be used to further develop the invention such that limits can be determined as to whether or not a particular customer can be catered for using the automated procedure for estimating body measurements. Taking for the moment the graph of FIG. 4, a boundary is placed around the region of the results having the highest density of data and that boundary may for example comprise an ellipse or an oval, which may extend beyond the limits of the right fit zone. If the input variables supplied by a potential customer place them outside the boundary, they are defined as impractical to supply. This may be caused by extraordinary or very inaccurate input variables being supplied on their part and could result in a message being sent to them interactively recommending that they check their input variables or possibly even be measured professionally.

A database could also be set up in which details of extraordinary customers is kept, along with records of the measurements used in any orders which are returned or reported as badly fitting, e.g. warranty returns. Further records would advantageously kept in this database of orders where no complaint was made. The data gathered in this way is then used to update the population sample records and/or predictor rules so as to protect against trends towards inaccuracy from negative or out of tolerance inputs, or to bolster confidence in robustness from positive results as the case may be. The database can be integrated with the records of the original/updated sample or be separate from it, such as might prove necessary in the event that a third party database was bought-in. The information so gathered could also be used to protect against customers who are difficult to satisfy, for example by making a record of customers who habitually return goods for whatever reason.

The invention claimed is:

1. An arrangement for generating a design of made to order clothing, comprising a controller operatively connected to an input means, the input means being adapted to provide to the controller with a plurality of body measurement input variables and a further input variable personal to a particular customer and the controller being adapted to process the input variables to predict a set of at least estimated body measurements, the set of estimated body measurements being predicted from one or more of the input variables, the arrangement further comprising means for deriving clothing pattern data from the estimated body measurements, wherein the further input variable is a representation of the age of the customer, and wherein the controller includes means to generate the estimated body measurements based on a non-linear relationship of the age.

2. An arrangement according to claim 1, the input variables further including an input of one or more of the weight, height, collar size, sleeve length and waist of the customer.

3. An arrangement according to claim 1, wherein the estimated body measurements include at least one of chest circumference, waist circumference, arm circumference, wrist circumference, shoulder length, arm length and back length.

4. An arrangement according to claim 1, wherein the controller for estimating the estimated body measurements on the basis of a plurality of the input variables includes means for accessing a set of predictor rules.

5. A arrangement according to claim 4, wherein the controller includes means for applying the predictor rules to the input variables and for generating at least one estimated body measurement in accordance with the predictor rules.

6. An arrangement according to claim 5, wherein the means for applying the predictor rules includes means for applying a regression technique.

7. An arrangement according to claim 6, wherein the means for applying a regression technique comprises means for applying a multiple linear regression technique.

8. An arrangement according to claim 5, wherein means for applying the predictor rules includes means for changing the predictor rules between a first and a second application thereof to reflect at feast one of a change in the sample overtime, in target markets or in a geographical area.

9. An arrangement according to claim 5, wherein the means for applying the set of predictor rules includes means for generating the predictor rules in accordance with one of each time a design is requested and each time a reference database of sample body measurements is changed.

10. An arrangement according to claim 4, wherein the predictor rules are derived from a database of body measurements of a population sample, the sample preferably being composed of at least twenty times more cases than there are variables to be entered and body dimensions to be predicted.

11. An arrangement according to claim 1, wherein the made to order clothing includes one of a shirt, a blouse, a jacket, and a pair of trousers and in the case of trousers the body measurement input variables include one or more of foot size, shoe size, inside leg and seam size.

12. An arrangement according to claim 1, wherein the made to order clothing further includes a jacket, and optionally a waist coat, in combination with the trousers.

13. An arrangement according to claim 1, further comprising means for receiving a command relating to a structure of at least a portion of the clothing and the arrangement further comprises means for displaying a predicted or simulated finished piece of the clothing and means for changing the command after displaying the predicted or simulated finished piece of the clothing.

14. An arrangement according to claim 13, wherein the structure is at least one of a type of material, a colour, a shape, a fit, a collar design, a cuff design and a sleeve design.

15. An arrangement according to claim 1, wherein the input means includes means for receiving interactive responses from at feast one of a wide area network (WAN), a local area network (LAN), a mobile telecommunications network, an internet ordering process and an interactive mail order process.

16. An arrangement according to claim 1, further comprising a clothing manufacturing facility, the facility having means to receive from the controller the pattern data and to produce the made to order clothing therefrom.

17. An arrangement according to claim 16, further comprising a billing and distribution arrangement for billing customers and shipping to them the made to order clothing.

18. An arrangement according to claim 1, further comprising means for displaying to a customer a virtual representation of the made to order clothing.

19. Arrangement according to claim 18, wherein the means for displaying displays the virtual representation in three dimensions further comprising means for changing the viewing angle of the virtual representation so as to show what the clothing might look like from different viewing angles.

20. An arrangement according to claim 1, further comprising means for displaying to a customer a representation of a virtual person representative of a body shape in accordance with the estimated body measurements, the representation being of the virtual person wearing a piece of the made to order clothing in accordance with the pattern data, the virtual person being displayed in three dimensions (3-D), further comprising means for changing the viewing angle of the virtual person so as to demonstrate what the clothing might look like in use.

21. An arrangement according to claim 20, wherein the means for displaying includes means for displaying the representation in a plurality of different poses and backgrounds.

22. An arrangement according to claim 20, wherein the means for displaying includes means for displaying the virtual person wearing clothing in addition to the made to order clothing, the additional clothing being at least a choice of trousers.

23. An arrangement for generating a design of made to order clothing, comprising a controller operatively connected to an input means, the input means being adapted to provide to the controller with a plurality of body measurement input variables and a further input variable personal to a particular customer and the controller being adapted to process the input variables to predict a set of at least estimated body measurements, the set of estimated body measurements being predicted from one or more of the input variables, the arrangement further comprising means for deriving clothing pattern data from the estimated body measurements, wherein the further input variable is a representation of the age of the customer, and wherein the input variables comprise only the age, weight, height and collar size of the customer.

* * * * *